US005363989A

United States Patent [19]

Zeamer et al.

[11] Patent Number: 5,363,989

[45] Date of Patent: Nov. 15, 1994

[54] AUTOMATIC CONTROL APPARATUS FOR A BEVERAGE TAP

[75] Inventors: Paul Zeamer, Madison; Delbert E. Lins, Spring Green, both of Wis.

[73] Assignee: DEC International, Inc., Madison, Wis.

[21] Appl. No.: 89,010

[22] Filed: Jul. 9, 1993

[51] Int. Cl.[5] ..... B56D 5/30

[52] U.S. Cl. ..... 222/16; 222/504; 222/641; 222/153; 137/382; 251/30.01; 251/58

[58] Field of Search ..... 267/154, 155; 137/382; 251/30.01, 58, 153; 222/14, 16, 63, 504, 640, 641

[56] References Cited

U.S. PATENT DOCUMENTS

| | | | |
|---|---|---|---|
| 1,128,060 | 2/1915 | Schorik et al. | 222/14 |
| 3,107,705 | 10/1963 | Isserstedt | 222/641 X |
| 3,257,033 | 6/1966 | Stott | 222/640 X |
| 3,280,806 | 10/1966 | Iskenderiah | 267/155 X |
| 3,355,068 | 11/1967 | Harland et al. | 222/641 X |
| 3,386,629 | 4/1968 | Kontra et al. | 222/504 X |
| 3,668,479 | 6/1972 | Weston et al. | 222/641 X |
| 3,718,233 | 2/1973 | Nordhoff | 222/641 |
| 3,813,008 | 5/1974 | Olson | 222/641 |
| 4,004,715 | 1/1977 | Williams et al. | 222/640 X |
| 4,057,173 | 11/1977 | Tal | 222/20 |
| 4,111,243 | 9/1978 | Fetterman | 141/102 |
| 4,224,959 | 9/1980 | Fling | 137/343 |
| 4,225,057 | 9/1980 | Horn | 222/27 |
| 4,226,343 | 10/1980 | Fling | 222/504 |
| 4,979,641 | 12/1990 | Turner | 222/25 |
| 5,022,557 | 6/1971 | Turner | 222/54 |
| 5,027,284 | 6/1991 | Senghaas et al. | 364/479 |
| 5,044,528 | 9/1991 | Becker | 222/504 |
| 5,124,934 | 6/1992 | Kawamoto et al. | 364/510 |
| 5,193,718 | 3/1993 | Hassell et al. | 222/129.1 |

FOREIGN PATENT DOCUMENTS

| | | | |
|---|---|---|---|
| 676771 | 12/1963 | Canada | 222/640 |
| 231578 | 8/1987 | European Pat. Off. | 222/504 |

*Primary Examiner*—Andres Kashnikow
*Assistant Examiner*—Kenneth Bomberg
*Attorney, Agent, or Firm*—Quarles & Brady

[57] ABSTRACT

A controller for a beverage tap has a base with a fastener for attaching the base to the beverage tap. A pneumatically-operated cylinder is mounted on the base and has a piston which when the cylinder is pressurized forces a lever of the tap into an open position. A cover releasably extends around five sides of the base and encloses the cylinder. A torsion spring is attached inside the cover to bias the lever into a closed position when the cylinder is not pressurized. A plurality of push button switches are mounted on the cover for operating the controller. A first electrical connector is attached to the base and has two guides that have conical apertures. A second electrical connector is movably attached to the cover, and includes two pins located within apertures of the two guides. The first and second electrical connectors have contacts formed by a pair of tines. Each pair of tines of one electrical connector slide in between and mesh perpendicularly with a pair of tines of the other electrical connector.

22 Claims, 3 Drawing Sheets

FIG. 3
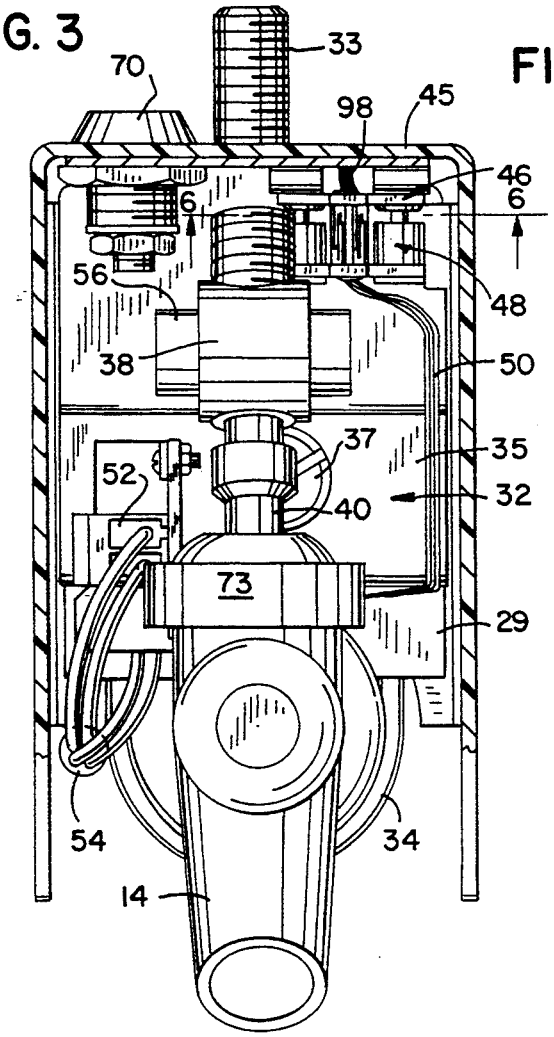
FIG. 4
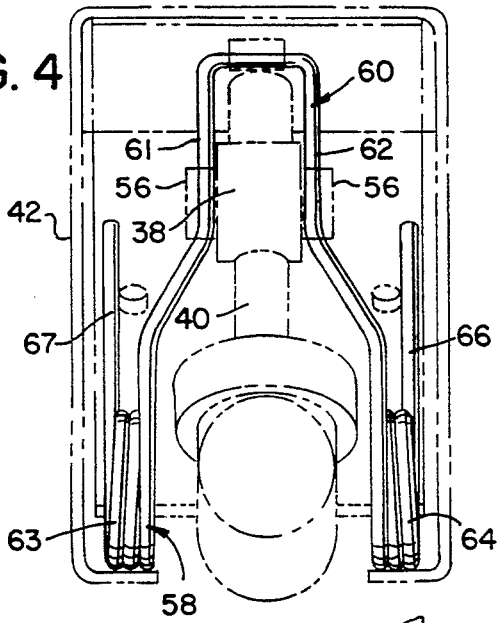
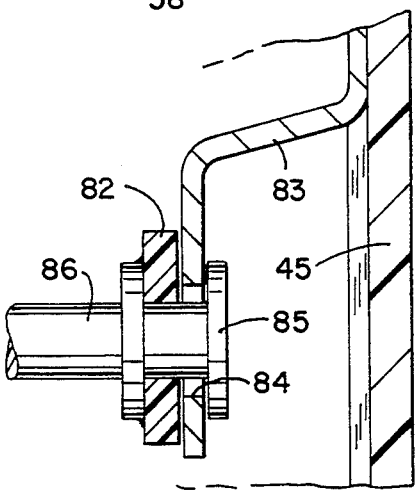
FIG. 7
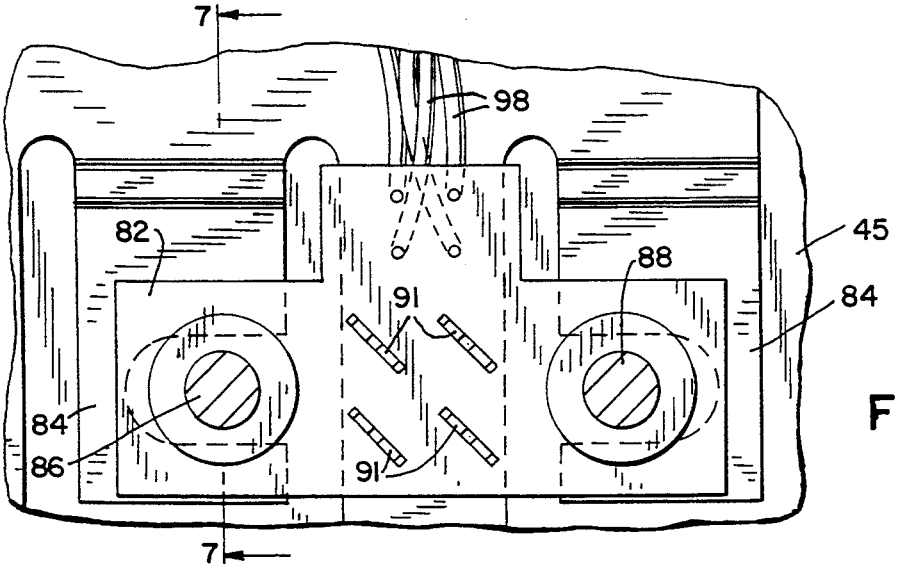
FIG. 6

FIG. 5
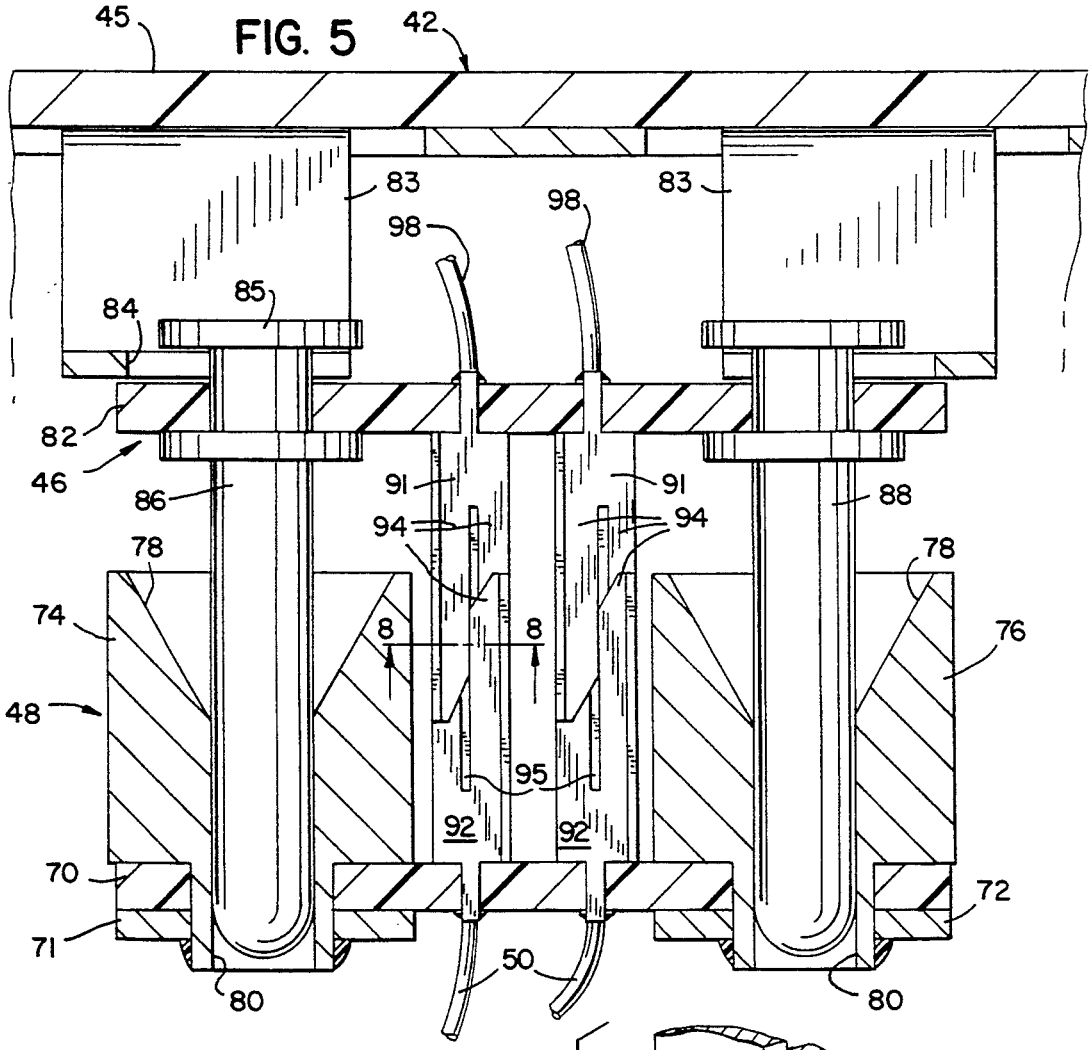
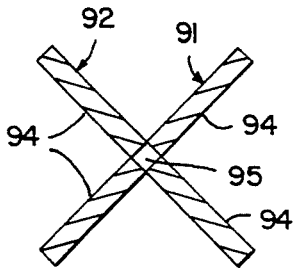
FIG. 8
FIG. 9
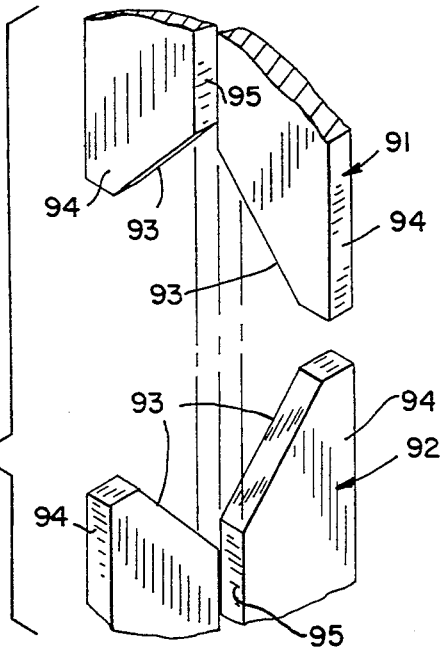

AUTOMATIC CONTROL APPARATUS FOR A BEVERAGE TAP

BACKGROUND OF THE INVENTION

The present invention relates to automatic beverage dispensing systems, and particularly to such systems for controlling the operation of a conventional tap.

Automatic soft drink dispensing systems are quite common in fast food restaurants for filling different sized beverage containers. Such systems include a number of push buttons by which the server designates the size of the container to be filled. In response to the activation of one of the push buttons, a corresponding amount of beverage flows through a spout into the container. These systems do not provide any mechanism for manually dispensing beverages in the event of a power failure.

Beer is commonly dispensed through a manually operated tap in which the bartender grasps a handle mounted on a lever of the tap. Movement of the lever in one direction opens a valve within the tap allowing the beer to flow through a spout into a container placed under the tap. Movement of the handle in the opposite direction closes the valve and terminates the flow of beer. Although it is desirable to provide an automated system for dispensing beer, the large installed base of manual taps makes it economically disadvantageous to replace all of the manual systems with completely automated ones similar to those being used for soft drinks. Furthermore, there is reluctance among tavern owners to adopt a fully automated system that cannot be operated manually in the event of a power failure.

As a consequence, it is desirable to provide a control mechanism for dispensing beer which can be attached to existing conventional taps to provide automated operation. It is further desirable to be able to easily disable such a retrofitted device and permit manual operation of the tap in the event of a power or equipment failure.

Brewers recommend that beer taps and lines feeding the taps be cleaned on a regular basis, as often as once a week, to avoid the beer having an off-taste or particles. Such cleaning requires the disassembly of the beer tap. Therefore components of an automated dispensing system must permit easy cleaning of the tap so that the bartender is not discouraged from performing the cleaning.

SUMMARY OF THE INVENTION

A controller is provided to operate a conventional beverage tap to automatically dispense a prescribed amount of the beverage. The controller has a base with a fastener for attaching the base to the beverage tap. A pneumatic cylinder is mounted on the base and has a piston which when the cylinder is pressurized applies force to a lever of the tap thereby causing a beverage to flow from the tap. A cover is releasably secured over the base and the cylinder. A torsion spring is attached to the cover and forces the tap lever into a closed position when the cylinder is not pressurized. A plurality of push button switches are located on the cover for operating the controller.

Electrical signals are conveyed between components on the cover and the base through a pair of connectors. A first connector is attached to the cover and a second connector is mounted to the base. One of the first and second connectors has two guides with each guide having a conical aperture. The other of these connectors has two pins that nest within apertures of the guides. As the cover is placed onto the base, conical shape of the guide apertures direct the pins as they enter the apertures, as an aid to the mating of the two connectors.

The first and second connectors have a plurality of electrical contacts with each contact formed by a pair of tines. The pairs of tines of the first connector slide in between and mesh with the pair of tines of the second connector to establish a signal path therebetween. In the preferred embodiment, each pair of tines of one connector lies in a plane that is perpendicular to the plane of the mating pair of tines of the other connector. Preferably, the tips of the tines are tapered to aid in the meshing as the cover is placed over the base.

A general object of the present invention is to provide an automated beverage dispensing controller that can be attached to operate a conventional tap.

Another object is to provide such a controller that permits manual operation of the tap when circumstances so require.

A further object is to locate all of the sensitive electronic control circuitry components of the control unit that easily can be removed from the tap. This allows the tap to be cleaned without risking damage to the control circuitry of the automated system. To facilitate removal and reassembly of the control unit a self guiding electrical connector mechanism is incorporated between its cover and base components.

Yet another object of the present invention is provide a control unit that attaches to the tap in a manner that facilitates disassembly for cleaning. This object is fulfilled by designing the cover to slide easily onto and off of a base assembly, and by enabling similar attachment of the pneumatic cylinder to the base.

BRIEF DESCRIPTION OF THE DRAWINGS

FIG. 3 is a sectional view taken along line 3—3 of FIG. 1;

FIG. 4 is an view taken along line 4—4 of FIG. 2 showing the torsion spring in the control unit;

FIG. 5 is a sectional view taken along line 5—5 in FIG. 2 showing mated electrical connectors in the control unit;

FIG. 6 is a sectional view taken along line 6—6 through the mated electrical connectors in FIG. 3;

FIG. 7 is a detailed view of the movable attachment of one of the electrical connectors to the control unit cover;

FIG. 8 is a cross sectional view through the mated contacts of the electrical connectors; and FIG. 9 is an exploded vied of the electrical connector contacts.

DETAILED DESCRIPTION OF THE INVENTION

Figure 1:
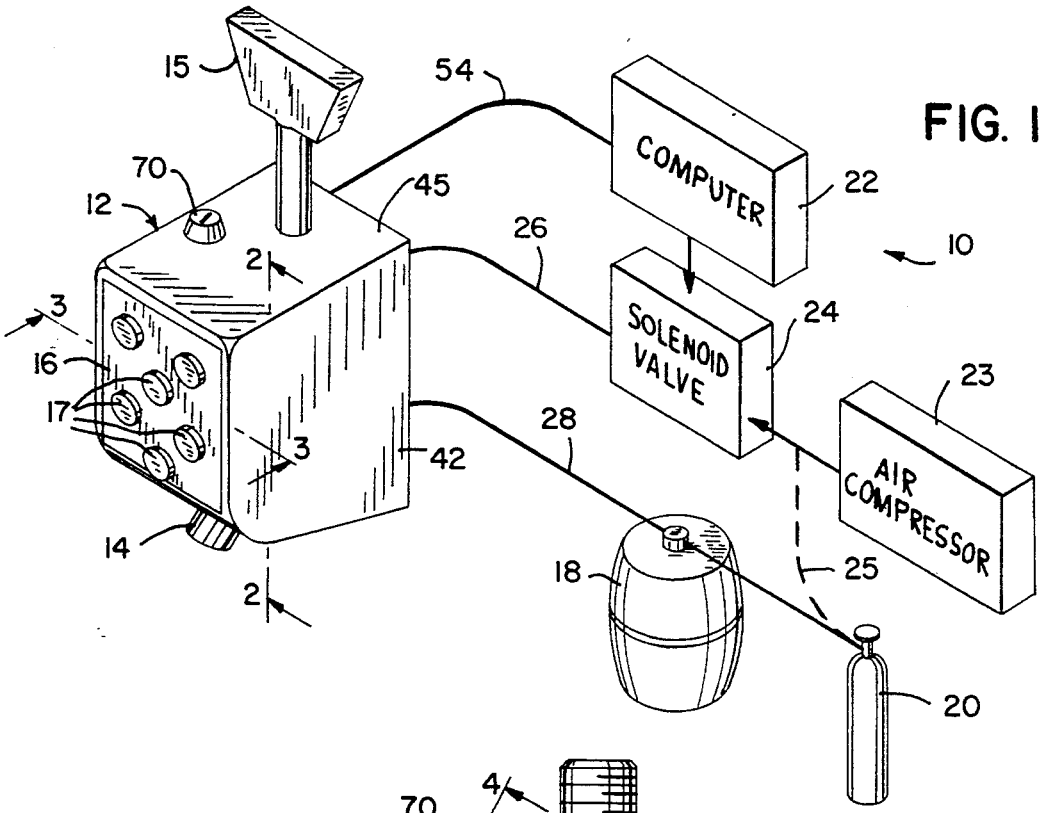
FIG. 1 is a pictorial view of a beverage dispensing system with a control unit mounted on a tap.

With initial reference to FIG. 1, a system 10 automatically dispenses of different quantities of a beverage, such as beer, to fill a glass, a mug or a pitcher as selected by the user. The system 10 operates a standard tap 14 supplied with beer from a keg 18 which is pressurized by a cylinder of carbon dioxide gas 20. A control unit 12 attaches to the tap and has a keypad 16 by which the bartender selects the desired dispensing function. For example, several push button switches 17 on the keypad 16 select whether a glass, a mug or a pitcher of beer is to be filled. Other push button switches cancel a pour that is in progress or repeat the pour for another container of like size.

The keypad 16 is connected to a communication interface circuit 44 (FIG. 2) that sends control signals to a computer 22. The computer responds to a signal indicating the depression of a push button switch 17 for a designated container by opening the tap 14 until the corresponding quantity of beer has been dispensed. Specifically, the computer 22 activates a solenoid valve 24 sending pressurized air from a compressor 23 through tube 26 to the control unit 12. A pneumatic cylinder in the control unit opens the tap in response to the pressurized air in the tube 26. Alternatively, the air compressor 23 can be replaced by a line 25 from the carbon dioxide cylinder 20 to provide a source of pressurized gas for operating the tap. As yet another alternative the solenoid valve 24 can be part of the control unit 12 attached to the tap 14.

The tap 14 remains open for a given period of time as determined by the computer based on the designated size of the container. Then, the solenoid valve 24 is de-energized to release the air pressure in tube 26 and close the tap 14. If the flow of beer to the tap is not uniform, a flow meter can be placed in supply line 28 so that the computer 22 is able to measure the precise amount of beer dispensed. In this alternative, the dispensed amount, not time, determines when the tap is to be closed.

Figure 2:
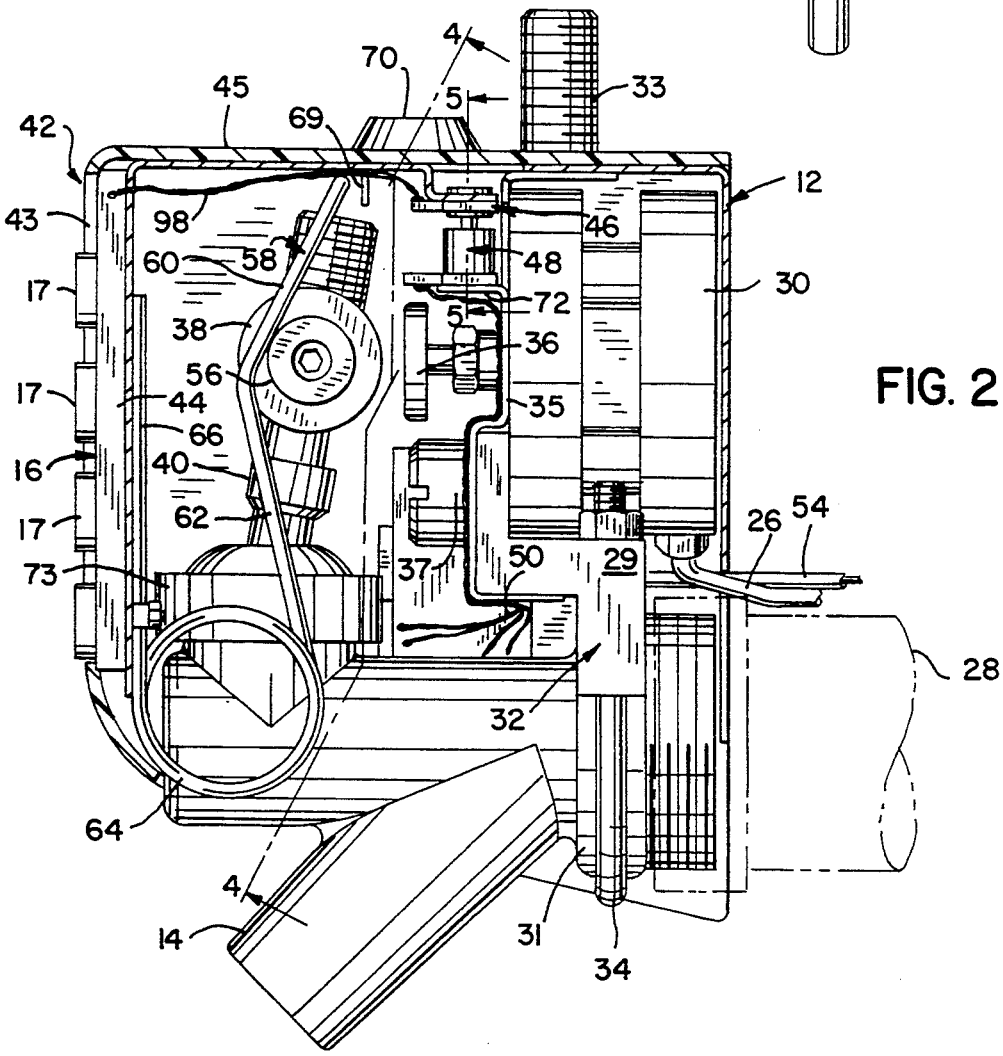
FIG. 2 is a sectional view of the control unit taken along line 2—2 of FIG. 1.

With reference to FIGS. 2 and 3, the control unit 12 has a base 32 comprising a mount 29, a brass U-bolt 34 and a bracket 35. The mount 29 is formed of plastic material and is held on the tap 14 by the U-bolt 34 which extending around a flange 31 at the rear of the tap. The bracket 35 slides sideways onto the base 32 and is held in place by a bolt 37. A pneumatic cylinder 30 is mounted on the bracket 35. The pneumatic cylinder 30 has a piston 36 which extends through a hole in bracket 35 and which is driven outward when pressurized air is fed to the cylinder through tube 26. In that event, the piston 36 presses against a cylindrical element 38 attached to the operating lever 40 of the tap 14 and moves the lever into an open position.

A cover 42 of the control unit 12 extends on five sides over and around the base 32, cylinder 30, and the upper portion of the tap 14. The cover 42 shields internal electrical components from liquid that becomes splashed onto the control unit. Cover 42 has an open bottom so that it can be slid off of and back onto the base 32, as will be described.

A torsion spring 58 is attached to the inside of front portion 43 of the cover 42 and presses against shoulders 56 at ends of cylindrical element 38. The spring 58 has a U-shaped center section 60 formed by two legs 61 and 62 as shown in detail in FIG. 4. An end of each leg 61 and 62 is connected by a separate torsion coil 63 and 64, respectively, to straight end portions 66 and 67 that are attached inside the front portion 43 of cover 42. The torsion spring 58 applies bias force against the cylindrical element 38 and thus the tap lever 40 to close the tap 14 when pressurized air is not being applied to the pneumatic cylinder 30. It is the force of the torsion spring 58 which maintains the tap in a normally closed state. The use of the spring to close the tap valve avoids relying on the pressure of the beverage or using reverse air pressure in cylinder 30 to close the tap. The engagement of the spring 58 with the tap lever 40 takes advantage of the mechanical leverage provided by the lever. The U-shaped construction of the torsion spring facilitates removal and replacement of the cover over the base without direct contact of the spring by the bartender. The U-shape of spring 58 with torsion coils 63 and 64 on each side balance the force exerted on the tap lever 40 and prevents center section 60 of the spring from disengaging the tap lever.

A threaded rod 33 is connected at the top of the bracket 35 and projects upwardly therefrom. The cover 42 has an aperture through which the threaded rod 33 extends when the cover is assembled on the base 32. The threaded rod is used to attach a conventional beer tap handle 15 (FIG.. 1) to the control unit 12 to provide an indication of the type of beverage being dispensed by that tap.

The front portion 43 of the cover 42 contains the keypad 16 on its outer surface. On the inside of the front portion 43 is an electronic circuit 44 which acts as a communication interface to exchange signals with computer 22 in response to activation of a push button switch 17. Wires 98 extend from the electronic circuit 44 to an electrical connector 46 attached on the underside of the top portion 45 of cover 42. Connector 46 is mounted to the cover in a manner which permits the connector to move along two axes in a plane parallel to the top portion 45 of the cover. As will be described, this movement of the cover connector 46 facilitates mating of the electrical connector with a corresponding electrical connector 48 attached to the base 32 and compensates for variations in fit between the base and cover when they are mounted on the tap. Other wires 50 extend from the base connector 48 to terminals 52 that connect the control unit to the electrical cable 54 from computer 22.

A key lock 70 is located through an aperture in the upper surface of cover 42. The portion of the lock within the control unit 12 engages a catch on bracket 35 in order to lock the cover to the base 32 and prevent unauthorized removal. When it is necessary to clean the tap 14 or to provide manual operation, a person inserts a key into lock 70 and operates the lock to release the engagement with the latch on an upper region of the base bracket 35. The beer tap handle 15 is removed from rod 33 as shown in FIGS. 2 and 3, which enables the unlocked cover 42 to be slid upward off of the base 32. As the cover 42 is being moved upward, the two electrical connectors 46 and 48 disengage. This action also causes the torsion spring 58 to disengage from the cylindrical element 38 and rest against a stop 69 on the inner surface of the top portion 45 of the cover.

The removal of the cover 42 allows handle 15 to be placed on the exposed end of lever 40 enabling manual operation of the tap 14 in a conventional fashion with the pneumatic cylinder 30 depressurized. As a result of this capability, should automatic operation be disabled, due to a power outage or a component failure, removal of the cover 42 permits manual dispensing. The base 32 and components mounted thereon are designed not to interfere with such manual operation.

With the cover 42 removed the tap may also be cleaned. However, first the tap bonnet 73 is unscrewed from the main body of the tap 14 and the tap lever 40 is removed, as normally are done to clean the tap. With the tap lever removed, the bartender can insert a screwdriver blade or a coin into the slot of bolt 37 and remove the bolt. This enables the bracket 35 to be slid sideways off of the mount 29, thereby removing the pneumatic cylinder 30, electrical connector 48 and electrical terminals 52 from the tap 14.

The removal of the cover 42 and bracket 35 allows access to every side of the beverage tap 14 for cleaning. All of the sensitive electrical components are mounted on the cover 42 or the bracket 35 so that the tap 14 now may be cleaned without the possibility of damaging those components with cleaning solutions or short circuiting the control circuitry.

The control unit 12 is assembled by sliding the bracket 35 sideways onto the mount 29 and replacing bolt 37. Next, the tap lever 40 and bonnet 72 are installed. Cover 42 then is slid downward over the base 32 with the threaded rod 33 aligned with the opening in the top portion of the cover allowing the cover to slide downward over the rod and around the base unit. As this action is occurring, the shoulders 56 on the cylindrical element 38 slide onto the legs 61 and 62 of the torsion spring 58, re-establishing the bias provided by the spring which holds the lever 40 in the closed position.

As the cover 42 is slid downward over the base 32, the two electrical connectors 46 and 48 automatically mate to establish electrical connection between the cover and base, without separate handling by the bartender. With reference to FIGS. 5–9, the base connector 48 has a platform 70 of electrically insulating material, which is attached to tabs 71 and 72 projecting from the bracket 35 portion of base 32. A pair of guides 74 and 76 have cylindrical projections extending through apertures of the platform 70 and the tabs 71 and 72 with the projections being rounded on the underside of the tabs to hold those components together. The ends of the guides 74 and 76, which are remote from the platform 70, have an aperture 80 extending therein. Each aperture 80 has a conical tapered opening 78 at the surface of the respective guide 74 and 76. The cover connector 46 has a similar platform 82 of electrically insulating material, which is attached to tabs 83 extending from the inside of top portion 45 of the cover. This attachment comprises pins 86 and 88 extending through slots 84 in the tabs 83 and apertures in the cover platform 82 to secure the components together. The pins 86 and 88 have heads 85 which are larger than the slots 84 to captivate the pins in the slots while allowing movement of the connector 46 in a horizontal plane in the orientation shown in FIG. 5.

This attachment mechanism enables the cover connector 46 to move as it is mating with the base connector 48. Specifically as the cover 42 is moved downward over the base 32, the pins 86 and 88 enter the conical openings 78 of apertures 80 within each guide 74 and 76. As the cover travels further downward, the pins are guided by the conical tapering surface of the opening into a center position where they enter the lower cylindrical portions of apertures 80. As the pins 86 and 88 are directed into the central orientation, the entire cover connector 46 moves laterally in two dimensions within the slots 84 of the two cover tabs 83. This movement aligns the two connectors for proper mating in spite of variations in fit between the cover and base. Although the base connector 48 has the guides and the cover connector 46 has the pins, the location of the pins and guides can be switched.

The two electrical connectors 46 and 48 have a plurality of electrical contacts 91 and 92, respectively. Each of the electrical contacts has a pair of tines 94 with a slot 95 extending longitudinally along the contact and separating the tines. The width of the gap between a pair of tines 94 is slightly less than the thickness of the tines as shown in FIG. 8. The contacts 91 on cover connector 46 are each associated with a contact 92 on the base connector 48 with the tines of each contact 91 lying in a plane that is perpendicular to the plane of the tines of the associated contact 92. Specifically, the longitudinal slot 95 between each pair of tines of contacts 91 on the cover connector 46 are aligned with a slot 95 between a pair of tines one of the base connector contacts 92. As the two connectors 46 and 48 come together, the slots of contacts 91 engage the slots in contacts 92 so that the two opposed pairs of tines 94 slide in between each other and mesh. The ends 93 of the tines 94 of each contact 91 and 92 that are remote from the respective platform 70 and 82 are tapered inward to guide the meshing of the opposing contacts as the cover 42 is assembled onto the base 32.

Because the width of the slot between the respective tines is slightly less than the tine thickness, an electrical contact is established between contacts 91 and 94 making electrical connection between components of the base and the cover. Wires 50 extend from the electrical contacts 92 on the base 32 to the terminals 52. Other wires 98 extend from the contacts 91 on the cover to the push button circuitry 44. This electrical connection applies power from the computer 22 to the circuitry 44 on the cover 42 and carries digital signals therebetween.

We claim:

1. A controller for a beverage tap comprising:

a base with a fastener for attaching said base to the beverage tap;

a pneumatically-operated cylinder mounted on said base and having a piston which when said cylinder is pressurized applies force to a lever of the beverage tap thereby causing a beverage to flow from the beverage tap;

a cover releasably secured to and around said base and having a plurality of switches for operating the controller;

a first connector attached on one of said base and said cover, and includes a guide mechanism with a pair conical apertures forming first and second guides, and first electrical contacts; and a second connector attached to another one of said base and said cover, and includes first and second pins located within apertures of said first and second guides, respectively, and second electrical contacts touching the first electrical contacts of said first connector, wherein said first and second connectors engage each other as said cover slides around said base.

2. The controller as recited in claim 1 wherein each of the electrical contacts of both the first and second connectors is formed by a pair of tines, each pair of tines of the first electrical connector slide in between and mesh with a pair of tines of the second electrical connector.

3. The controller as recited in claim 1 further comprising a mechanism for movably attaching said second connector to one or the other of said base and said cover.

4. The controller as recited in claim 1 further including a spring attached to said cover to bias the lever of the beverage tap into a closed position.

5. The controller as recited in claim 4 wherein said spring has first and second end sections attached to said cover, a U-shaped portion having two legs, a first torsion coil connecting one end section to one leg, and a second torsion coil connecting another end section to another leg, and wherein the U-shaped portion of said spring releasably engages the lever of the beverage tap.

6. The controller as recited in claim 5 further comprising a body attached to the lever and having two shoulders which receive the legs of the spring so that the spring engages the lever.

7. The controller as recited in claim 1 wherein said base includes a threaded rod projecting upwardly therefrom; and said cover has an aperture through which the threaded rod extends for attachment of an element that identifies the beverage being dispensed, said element securing said cover to said base.

8. The controller as recited in claim 1 wherein said cover has a keyed lock for securing the cover to the base.

9. The controller as recited in claim 1 wherein said base comprises a mount that is attachable by the fastener to the beverage tap; and a bracket that slidably and removably engages said mount, and said pneumatically-operated cylinder being mounted on said bracket.

10. A control system for a beverage tap comprising:

a base having a fastener for attaching the base to the beverage tap;

a pneumatically-operated cylinder mounted on said base and having a piston which operates a lever of the beverage tap to cause a beverage to flow from the beverage tap;

a cover releasably attached to said base and having a plurality of switches for operating the control system;

a first electrical connector attached to said base and having a first electrical contact with a first pair of tines located in a first plane; and a second electrical connector attached to said cover and to the switches, and having a second electrical contact with a second pair of tines located in a second plane that intersects the first plane, and the second pair of tines being in between and meshed with the first pair of tines, wherein the tines of said first and second electrical connectors become meshed as said cover slides around said base.

11. The control system as recited in claim 10 wherein one of said first and second electrical connectors includes first and second guides with each guide having a conical aperture; and wherein the other one of said first and second electrical connectors includes first and second pins located within apertures of said first and second guides.

12. The control system as recited in claim 10 further comprising a communication interface circuit mounted to said cover and electrically connected to the switches and said second electrical connector.

13. The control system as recited in claim 12 further comprising a mechanism which is electrically connected to said first electrical connector and which supplies pressurized fluid to said cylinder in response to a signal from said communication interface circuit.

14. The controller as recited in claim 10 wherein said base comprises a mount that is attachable by the fastener to the beverage tap; and a bracket that slidably and removably engages said mount, and said pneumatically-operated cylinder being mounted on said bracket.

15. An apparatus for controlling a beverage tap comprising:

a base with a fastener for attaching to the beverage tap;

a pneumatically-operated cylinder mounted on said base and having a piston which when said cylinder is pressurized forces a lever of the beverage tap into an open position to cause a beverage to flow from the beverage tap;

a cover releasably attached to said base and extending around said base and said cylinder; and a torsion spring attached to said cover for biasing the lever to close the beverage tap when said cylinder is not pressurized.

16. The apparatus as recited in claim 15 wherein said torsion spring has first and second end sections attached to said cover, a U-shaped portion with two legs, a first torsion coil connecting one end section to one leg, and a second torsion coil connecting another end section to another leg, wherein the U-shaped portion of said spring releasably engages the lever of the beverage tap when said apparatus is attached to the beverage tap.

17. The apparatus as recited in claim 16 further comprising a body attached to the lever and having two shoulders which receive the legs of the spring.

18. The apparatus as recited in claim 15 further comprising:

a first electrical connector attached to said base, and having first and second guides with each guide having an aperture; and a second electrical connector attached to said cover, and having first and second pins removably located within the apertures of said first and second guides, respectively;

wherein each of the first and second electrical connectors has a plurality of electrical contacts each of which formed by a pair of tines, and each pair of tines of the first electrical connector being in between and meshed with a pair of tines of the second electrical connector.

19. The apparatus as recited in claim 18 wherein said cover includes an attachment mechanism that permits said second electrical connector to move with respect to said cover.

20. The apparatus as recited in claim 18 wherein each of said first and second guides has a conical shaped opening of the aperture.

21. The apparatus as recited in claim 15 further comprising:

a first connector attached to said base and including first and second guides each of which has an aperture with a conical shaped opening, and further including a plurality of electrical contacts between the first and second guides with each contact having a pair of tines; and a second connector movably attached to said cover and having first and second pins removably located within the apertures of the first and second guides, respectively, and said second connector including a plurality of electrical contacts between the first and second pins with each contact having a pair of tines slid in between and meshed with a pair of tines of the first electrical connector.

22. The apparatus as recited in claim 15 wherein said base comprises a mount that is attachable by the fastener to the beverage tap; and a bracket that slidably and removably engages said mount, and said pneumatically-operated cylinder being mounted on bracket.

* * * * *